United States Patent [19]

Davis et al.

[11] 3,985,309

[45] Oct. 12, 1976

[54] CRUSHER CLEARING SYSTEM

[75] Inventors: D. Carter Davis, Menomonee Falls; Ulhas S. Sawant, Sussex, both of Wis.

[73] Assignee: Rexnord Inc., Milwaukee, Wis.

[22] Filed: May 27, 1975

[21] Appl. No.: 581,036

[52] U.S. Cl. ..... 241/290; 241/207

[51] Int. Cl.[2] ..... B02C 2/04

[58] Field of Search ..... 241/207, 216, 286, 290

[56] References Cited

UNITED STATES PATENTS

| | | | |
|---|---|---|---|
| 3,009,660 | 11/1961 | Symons et al. | 241/207 X |
| 3,140,835 | 7/1964 | Balmer et al. | 241/286 |
| 3,273,810 | 9/1966 | Gasparac et al. | 241/290 |
| 3,797,760 | 3/1974 | Davis et al. | 241/207 UX |
| 3,837,585 | 9/1974 | Decker et al. | 241/215 X |

*Primary Examiner*—Granville Y. Custer, Jr.
*Assistant Examiner*—Howard N. Goldberg
*Attorney, Agent, or Firm*—Kinzer, Plyer, Dorn & McEachran

[57] ABSTRACT

This is concerned with a crusher clearing system using a plurality of hydraulic jacks disposed with relation to the adjustment ring and main frame of the crusher such that the jacks, as a unit, apply a generally vertical thrust directly between the upper main frame flange and the adjustment ring so that uncrushable material may be removed from the crushing cavity in a stalled or jammed crusher. The jacks are arranged in pairs and the jacks are selectively energized so that the adjustment ring will tilt relative the main frame flange.

10 Claims, 3 Drawing Figures

28
12
14
22
32
2
30
70
30
38
32
42
2
16
18
10
46

CRUSHER CLEARING SYSTEM

SUMMARY OF THE INVENTION

This is concerned with a crusher clearing system using a plurality of hydraulic jacks and is more specifically concerned with a hydraulic system for clearing the crushing cavity by overcoming the spring release in a gyratory crusher so that uncrushable material may be removed from or allowed to pass through the crushing cavity in a stuck or plugged crusher.

A primary object of the invention is a crusher clearing system in which a plurality of hydraulic jacks are arranged around the crusher effective to apply a generally vertical thrust between the adjustment ring and the main frame.

Another object is a crusher clearing system in which standard jacks are used in multiple pairs or in multiples less than the total with a control so that the adjustment ring is raised on one side and pivoted on the other in a tilting action without raising the entire adjustment ring and bowl and compressing all of the springs.

Another object is a crusher clearing system using jacks in pairs, 90° apart, with the jacks mounted on the adjustment ring to apply downthrust to the main frame flange at the upper end of the main frame.

Another object is a crusher clearing system that uses standard jacks and does not require any special parts or components.

Another object is a crusher clearing system which is arranged for a simple fluid circuit.

Other objects will appear from time to time in the ensuing specification and drawings.

DESCRIPTION OF THE PREFERRED EMBODIMENT

Figure 1:
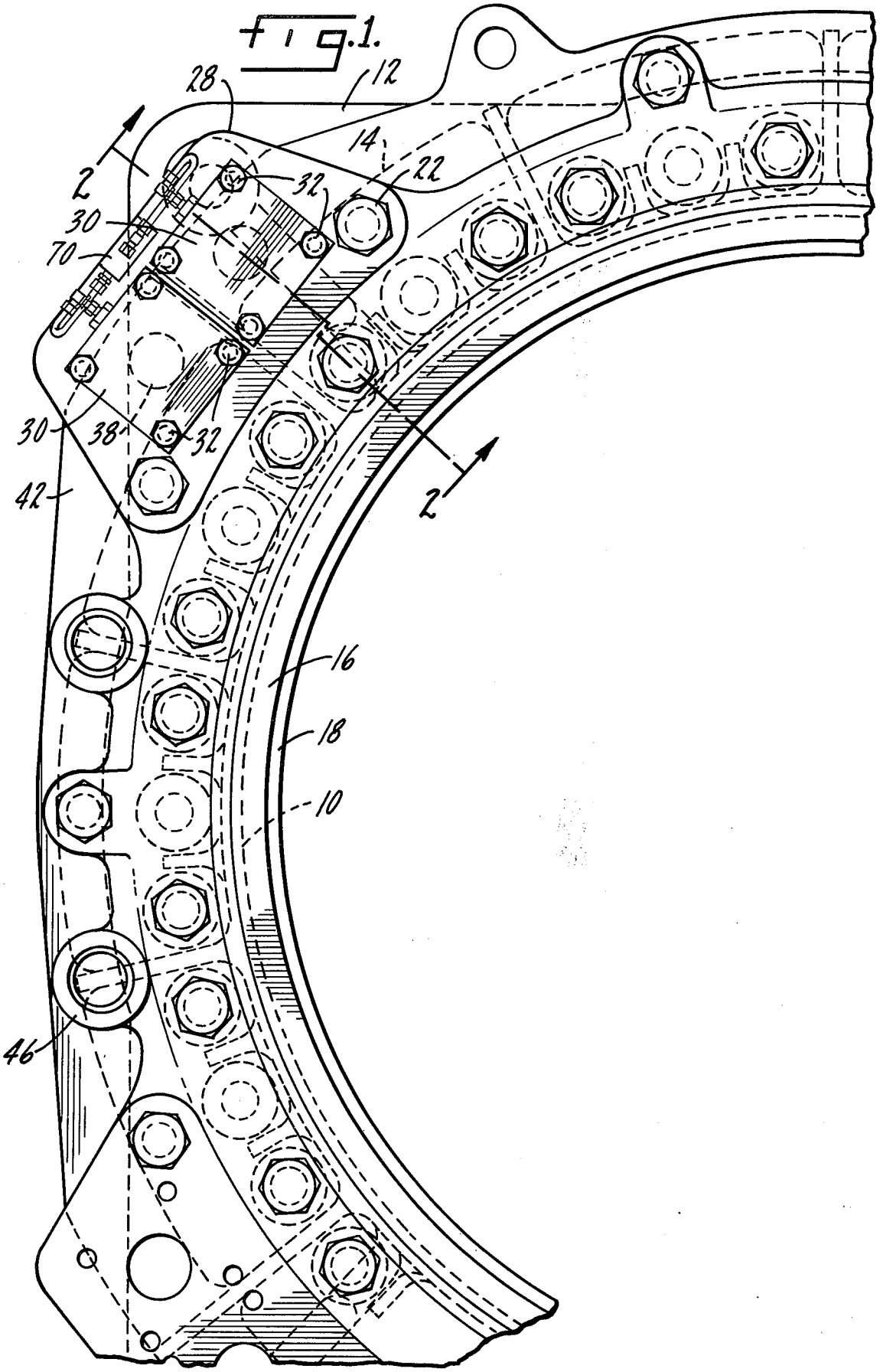
FIG. 1 is a top plan view of a part of a crusher frame with a hydraulic system for crusher clearance shown thereon.
Figure 2:
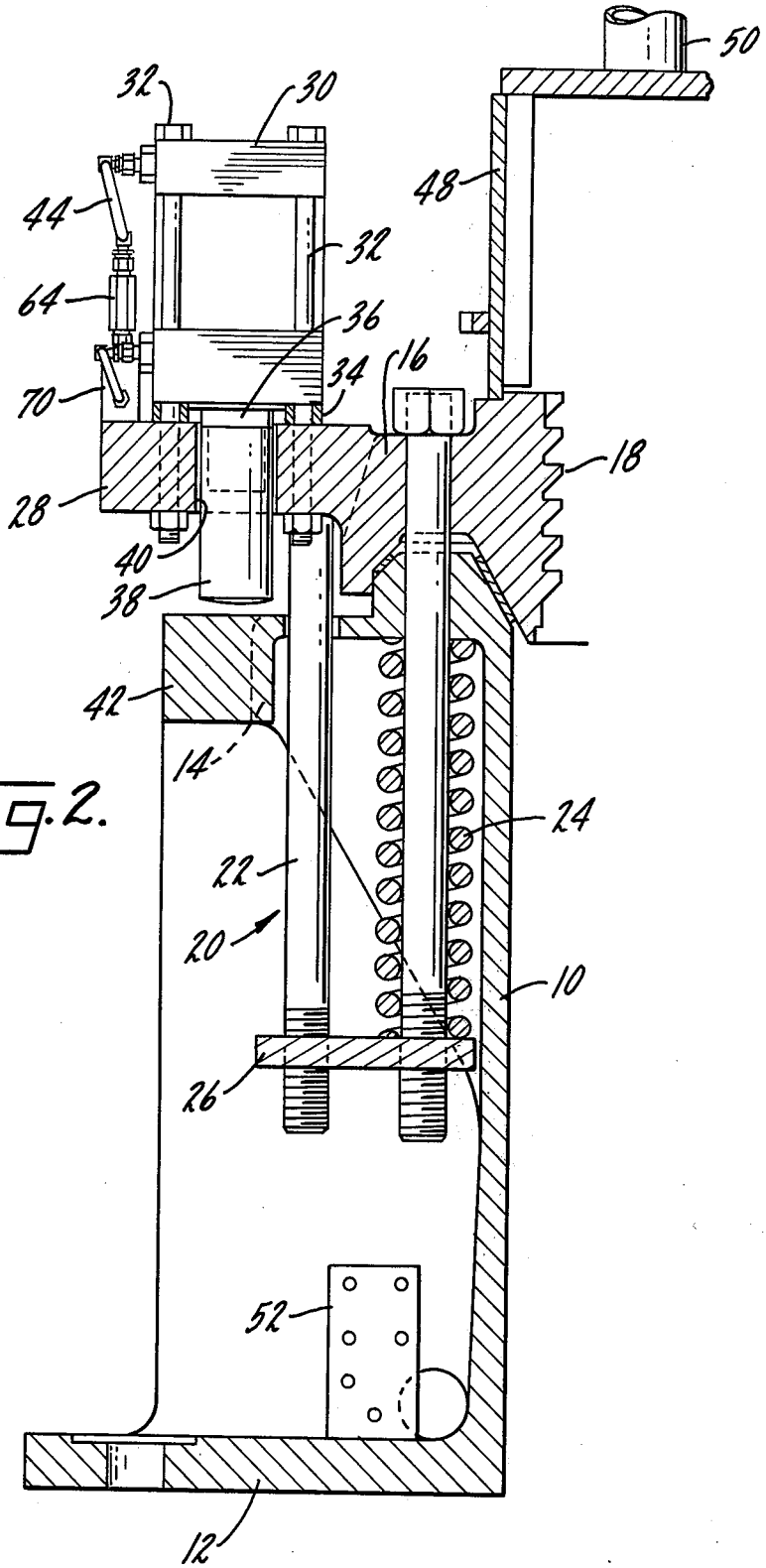
FIG. 2 is a section along line 2—2 of FIG. 1, with parts in full.

In FIGS. 1 and 2 a crusher is generally indicated as having a circumferential main frame 10 with a base flange 12 to be positioned against and possibly bolted to a foundation and with an upper outstanding flange 14 at or adjacent its upper end on which an adjustment ring 16 is mounted. The inner surface 18 of the adjustment ring is screw-threaded to accept a bowl for adjustment in a conventional manner. A spring release 20 includes a plurality of spring bolts 22 which pass through the adjustment ring and main frame flange with coil springs 24 being held against the underside of the main frame flange by a crosshead or spring retainer 26 in a conventional manner.

The adjustment ring 16 has a plurality of outstanding ears or projections 28, shown in this case as four, approximately 90° apart, which extend radially beyond the normal circumference of the adjustment ring as shown in FIG. 1. Each sure ear or projection carries a part of a release system which, as shown in FIGS. 1 and 2, includes a pair of hydraulic jacks 30 each of which is mounted on the upper surface of the adjustment ring projection by four bolts 32, one on each corner, with suitable spacers 34 or the like being used so that the jacks are evenly held and leveled on the upper surface of the adjustment ring. Each jack has a piston or plunger 36 which is screw-threaded or otherwise connected to an extension 38 which extends down through an opening 40 in the thickened projection 28 and aligned with an extension or enlargement 42 on the main frame flange. The jacks of each pair are connected to operate in parallel by suitable hydraulic connections 44 so that they extend and retract together. The jacks may be single-acting with fluid being applied to the top only. Or they may be double-acting, if desired.

It is intended that each of the jacks be a standard commercial item and the particular bolt mounting 32 allows them to be grouped together in pairs, one on each corner, 90° apart, so that sufficient thrust is obtained in the pairs for the purpose set forth hereinafter.

The adjustment ring may carry a suitable mounting 46 for one or more bowl-rotating rams and the top cap 48 may carry a plurality of hydraulic lock posts, one of which has been indicated at 50, for removing thread clearance between the adjustment ring and bowl, all of which may be conventional.

Figure 3:
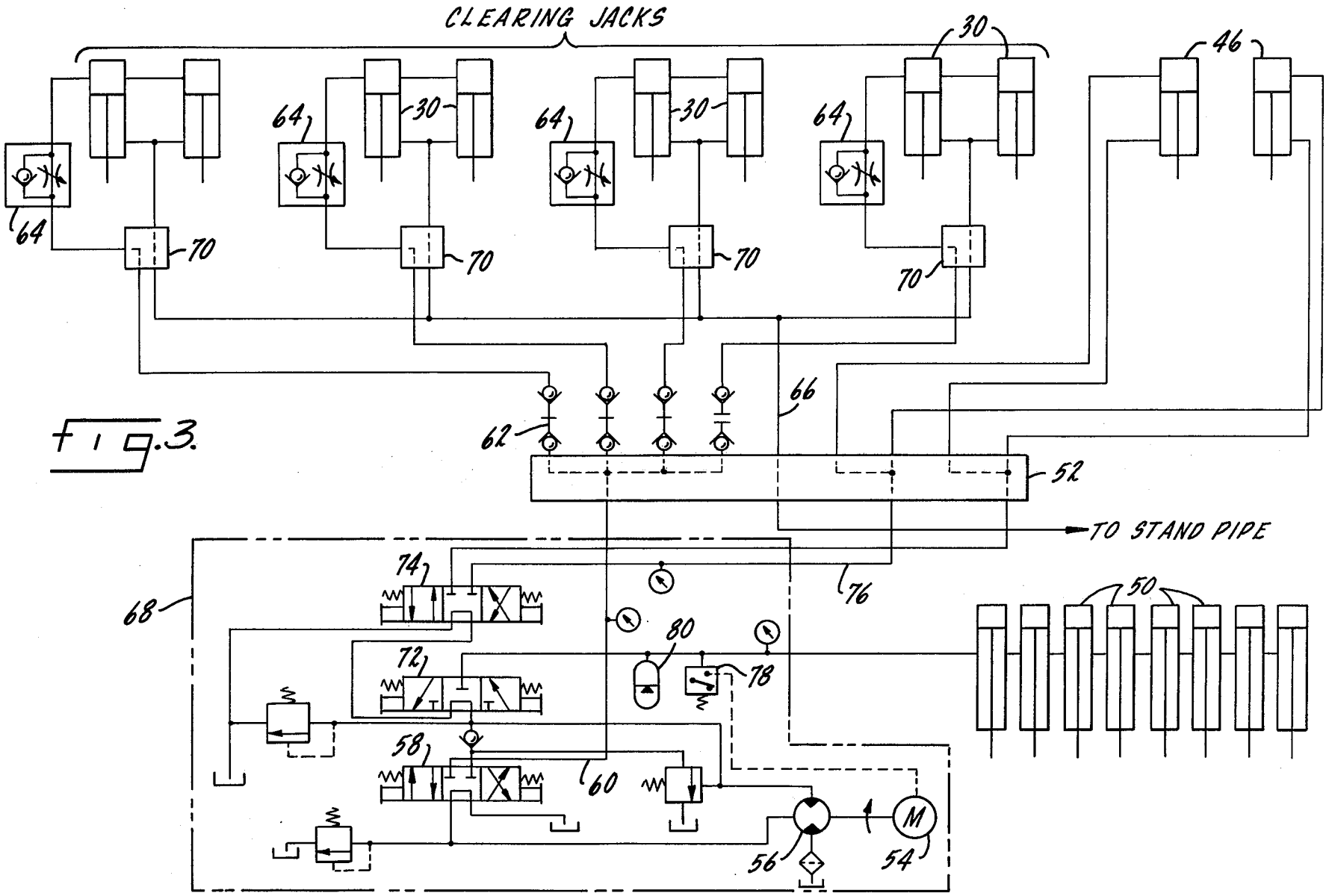
FIG. 3 is a schematic diagram of the hydraulics circuit used with FIGS. 1 and 2.

The various hydraulic lines and connections between the lock posts, the jacks, and the bowl-rotating rams may be controlled through a manifold block 52, suitably positioned on the base flange 12 or otherwise. In the hydraulic circuit in FIG. 3, an electric motor 54 drives a pump 56 and supplies fluid to a control valve 58 which controls the flow through a line 60 to the manifold block 52. The manifold block may have a series of quick disconnects 62, shown in this case as four, one for each of the pairs or sets of jacks to supply hydraulic fluid through the lines as shown to the pair of jacks, with each having a flow control valve 64 to slow their rate of descent in the event of a hydraulic failure. The piston side of the jacks may all be connected by a line 66 to a stand pipe in the oil reserve in the control console 68, this being an air connection, so that the air space above the oil in the reserve communicates with the rod side of the jacks, rather than the outside air, thereby providing a closed air system so that dirt and foreign matter will not be pulled into the cylinders. Each of the jack pairs may have its own manifold block 70 through which the oil and air lines are connected, which is also shown in FIGS. 1 and 2.

A second control valve 72 operates the hydraulic lock posts 50 which remove or control thread clearance with a third valve 74 controlling connection 76 through the manifold block 52 to the bowl-rotating rams 46. Leakage in the lock post 50 may be taken care of by a pressure-sensitive switch 78 which starts the pump motor when pressure drops to a certain level in the hydraulic lock posts. An accumulator 80 may also be used. Various relief valves are also shown on FIG. 3 and set to unload at any selected pressure to protect the system and the various components thereof, all of which may be conventional.

The use, operation and function of the invention are as follows:

Standard jacks are used and applied in multiple pairs, one on each corner of the crusher with the adjustment ring being specially constructed with outstanding ears or projections, 90° apart, with the jacks being mounted by tie rods on such ears or corners and acting down through the adjustment ring to apply a downthrust to a corresponding extension on the main frame flange. The jacks do not have to be specially made but can be standard units. As a group the jacks may not have sufficient capacity to overcome the entire spring release to raise the bowl and adjustment ring. To do this would require much bigger jacks which would be extremely expensive and unnecessary. Rather, in the arrangement shown the pairs of jacks on each corner may be selectively operated so that the adjustment ring is tilted to clear the cavity. For example, if the cavity is plugged on one side by tramp iron, a two-by-four, or what-have-you, the pair of jacks directly next to the point of the jam may be operated. If necessary, the jacks on each side thereof may be operated so that the three pairs of jacks bracketing the jam are energized. The pair of jacks on the opposite side from the jam, however, are not operated. Thus the adjustment ring will be tilted up at an angle with the jacks directly next to the jam being fully operated and the springs next to the jam being fully compressed. From that point around the crusher to the opposite side, the degree of compression of the springs will diminish on a proportional basis until on the side 180° from the jam, the springs will not be compressed at all. If the two adjacent sets of jacks are operated, they will not extend as far as the pair directly next to the jam, but they will augment the thrust and take their proportionate part or share of the load in compressing springs on each side of the jam.

This arrangement has the advantage that a stuck or plugged crusher can be cleared by this tilting action without raising the entire adjustment ring and bowl and compressing the springs all the way around which, if that was necessary, would require very large expensive jacks. By using the procedure outlined above, a crusher may be just as effectively cleared, but at a greatly reduced expense in equipment.

The selection of the particular jacks to operate might be done through a complicated valving mechanism, but in the arrangement shown a simple set of quick disconnects may be used with the operator on the job selecting and connecting the jacks he wants to operate and disconnecting the paired jacks most remote from the jam so that they do not operate. This is a very simple, economical way of operating the system without using expensive and cumbersome valving.

Connecting the air space below the pistons, on the rod side thereof, of all of the jacks through an air line to the air space above the oil reserve in the console gives a closed air system so that dirt will not be drawn into the jacks on the return stroke which, while it involves a simple connection, is an efficient and inexpensive way of protecting all of the jacks.

While a preferred form and several variations of the invention have been suggested, it should be understood that suitable additional modifications, changes, substitutions and alterations may be made without departing from the invention's fundamental theme. For example, hydraulic circuits have been shown and/or referred to. And it should be understood that fluid circuits might be a more appropriate term because many if not all aspects of the circuits could be hydraulic such as oil, pneumatic such as air or nitrogen, or a combination thereof. And the term fluid should be broadly construed.

Also, where a spring release has been referred to or described, it should be understood that in most instances either mechanical springs or air cylinders or a combination could be used.

The embodiments of the invention in which an exclusive property or privilege is claimed are defined as follows:

1. In a gyratory crusher, a generally upright circumferential main frame for enclosing a gyratable crushing head, an outstanding circumferential flange on the upper end of the main frame, an adjustment ring on the main frame flange adapted to support a crushing bowl in a position opposite the crushing head to thereby define a crushing cavity, a release yieldably holding the adjustment ring, and the bowl, down on the main frame and constructed to be overcome thereby allowing the adjustment ring and bowl to rise so that uncrushable material may pass between the head and bowl, and a jack system effective between the main frame flange and the adjustment ring including a plurality of jacks arranged in pairs, the pairs being generally equidistantly positioned about the crusher with each pair being disposed to apply an upthrust between the adjustment ring and main frame flange, and means for selectively energizing certain of the pairs and not others, depending upon the circumferential location of a jam in the crushing cavity, so that the adjustment ring may be controllably tilted to clear the side of the crushing cavity that is jammed.

2. The structure of claim 1 further characterized in that the pairs of jacks are four in number with the pairs being spaced approximately 90° apart.

3. The structure of claim 1 further characterized in that the pairs of jacks are mounted on top of the adjustment ring and apply a downthrust to the main frame flange.

4. In a gyratory crusher, a generally upright circumferential main frame for enclosing a gyratable crushing head, an outstanding circumferential flange at the upper end of the main frame, an adjustment ring on the main frame flange adapted to support a crushing bowl in a position opposite the crushing head, a release yieldably holding the adjustment ring down on the main frame flange and constructed to allow the adjustment ring to rise so that uncrushable material may pass through the crushing cavity between the head and bowl, and a jacking system disposed about the main frame to apply an upthrust to the adjustment ring including a plurality of jacks disposed at intervals about the crusher, and means for selectively energizing certain of the jacks and not others, depending upon the circumferential location of a jam in the crushing cavity, so that the adjustment ring may be controllably tilted to clear the side of the crushing cavity that is jammed while leaving the other side of the adjustment ring in contact with the main frame flange.

5. The structure of claim 4 further characterized in that the jacks are arranged in pairs with the pairs generally equidistantly positioned about the crusher.

6. The structure of claim 4 further characterized in that the jacks are mounted on top of the adjustment ring and apply a downthrust to the main frame flange.

7. In a gyratory crusher, a generally upright circumferential main frame for enclosing a gyratable crushing head, an outstanding circumferential flange on the upper end of the main frame, an adjustment ring on the main frame flange adapted to support a crushing bowl in a position opposite the crushing head to thereby define a crushing cavity, a release yieldably holding the adjustment ring, and the bowl, down on the main frame and constructed to be overcome thereby allowing the adjustment ring and bowl to rise so that uncrushable material may pass between the head and bowl, a hydraulic jack system effective between the main frame flange and the adjustment ring including a plurality of hydraulic jacks positioned about the crusher with each jack being disposed to apply an upthrust between the adjustment ring and main frame flange for clearing a jam, each jack having a hydraulic side and an air side, a control with a hydraulic reserve connected to the jacks for supplying pressure fluid to the hydraulic side of the jacks, and an air line between the air side of the jacks and the reserve in the control so that dirt will not be drawn into the jacks on their return stroke.

8. The structure of claim 7 further characterized in that the jacks are four in number and arranged in pairs which are spaced approximately 90° apart.

9. The structure of claim 7 further characterized in that the jacks are mounted on top of the adjustment ring and apply a downthrust to the main frame flange.

10. The structure of claim 7 in which the hydraulic side of the jacks is the piston side and the rod side is the air side.

* * * * *